US008944860B2

(12) United States Patent
Mulot et al.

(10) Patent No.: US 8,944,860 B2
(45) Date of Patent: Feb. 3, 2015

(54) ELECTRICAL FEMALE TERMINAL

(75) Inventors: Gerard Mulot, Nogent le Roi (FR); Arnaud Duquesne, Epernon (FR); Dominique Rozet, Rambouillet (FR)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 150 days.

(21) Appl. No.: 13/817,195

(22) PCT Filed: Aug. 5, 2011

(86) PCT No.: PCT/IB2011/002075

§ 371 (c)(1),
(2), (4) Date: Mar. 22, 2013

(87) PCT Pub. No.: WO2012/023037

PCT Pub. Date: Feb. 23, 2012

(65) Prior Publication Data

US 2013/0225016 A1 Aug. 29, 2013

(30) Foreign Application Priority Data

Aug. 17, 2010 (WO) ..... PCT/IB2010/002439

(51) Int. Cl.
*H01R 11/22* (2006.01)
*H01R 13/11* (2006.01)
*H01R 43/16* (2006.01)

(52) U.S. Cl.
CPC ..... *H01R 13/113* (2013.01); *H01R 43/16* (2013.01)
USPC ..... 439/852; 439/886

(58) Field of Classification Search
USPC ..... 439/852, 886
See application file for complete search history.

(56) References Cited

U.S. PATENT DOCUMENTS

| | | | | |
|---|---|---|---|---|
| 4,148,547 | A | 4/1979 | Otsuki et al. | |
| 5,607,328 | A | 3/1997 | Joly | |
| 5,947,777 | A | 9/1999 | Chaillot et al. | |
| 5,980,336 | A | 11/1999 | Hall et al. | |
| 6,152,787 | A | 11/2000 | Serbin et al. | |
| 6,203,385 | B1 | 3/2001 | Sato et al. | |
| 6,450,843 | B1 | 9/2002 | Heimuller | |
| 6,910,926 | B1 * | 6/2005 | Yamada | 439/886 |
| 2002/0065006 | A1 | 5/2002 | Heimueller | |

FOREIGN PATENT DOCUMENTS

| | | | |
|---|---|---|---|
| DE | 19826828 | A1 | 1/2000 |
| EP | 0727842 | A2 | 8/1996 |
| EP | 0812036 | A1 | 12/1997 |
| EP | 1122830 | A1 | 8/2001 |
| EP | 1146597 | A2 | 10/2001 |
| EP | 1156560 | A1 | 11/2001 |
| WO | 9511531 | | 4/1995 |
| WO | 9642121 | A1 | 12/1996 |
| WO | 2008120048 | A1 | 10/2008 |

OTHER PUBLICATIONS

International Search Report dated Dec. 14, 2011.

* cited by examiner

*Primary Examiner* — Gary Paumen
(74) *Attorney, Agent, or Firm* — Robert J. Myers

(57) ABSTRACT

An electrical female terminal, manufactured from a single metal sheet, comprising a crimping portion and a contact portion adapted to mate with a corresponding male terminal to be inserted therein, the contact portion comprising an outer frame having a top wall, a bottom wall parallel and opposed to the top wall, and two side walls, an inner frame encased in the outer frame, a first elastic contact member extending from the inner frame, and bearing on an inner portion of the bottom wall, a second elastic contact member extending from the inner frame and bearing on an inner portion of the top wall. The first and second elastic contact members have a convex shape oriented toward one another.

13 Claims, 5 Drawing Sheets

FIG.3.
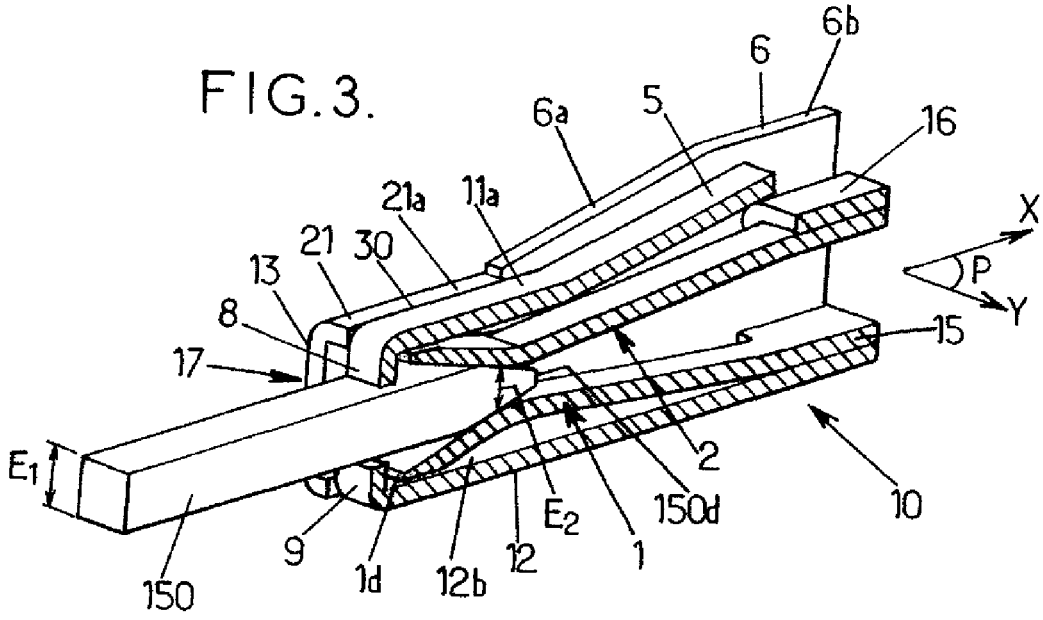
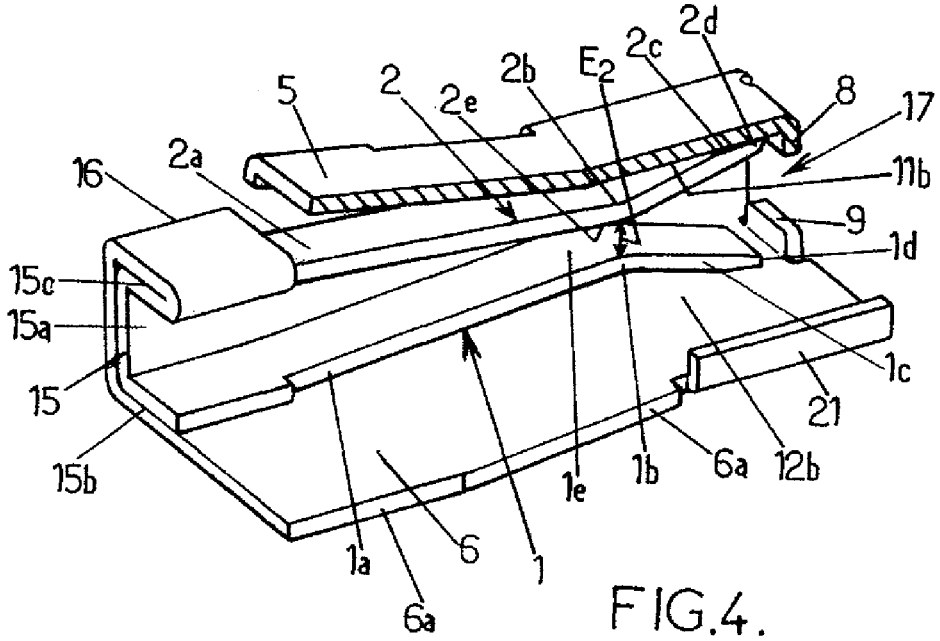
FIG.4.

ELECTRICAL FEMALE TERMINAL

CROSS-REFERENCE TO RELATED APPLICATIONS

This application is a national stage application under 35 U.S.C. §371 of PCT Application Number PCT/IB2011/002075 having an international filing date of Aug. 5, 2011, which designated the United States, which PCT application claimed the benefit of PCT Application Number PCT/IB2010/002439, filed Aug. 17, 2010, the entire disclosure of each of which are hereby incorporated herein by reference.

FIELD OF THE INVENTION

The invention relates to electrical terminals.

BACKGROUND OF THE INVENTION

For electrical connection, it is common to provide a so-called 'female' electrical terminal, which defines a cavity to receive a complementary so-called 'male' terminal.

The present invention relates to a female electrical terminal having an outer frame and an elastic member. The outer frame is designed to receive the complementary male terminal. The elastic member applies a force on the male terminal inside the cavity, to retain the male terminal therein. The elastic member also ensures a good physical terminal between the two electrical terminals, and hence a correct conduction of electricity.

Such electrical terminals are known from document WO2008/120048.

An aim of the invention is to increase the retention force between the male and female terminals.

BRIEF SUMMARY OF THE INVENTION

The electrical terminal according to the invention is manufactured from a single metal sheet.

The electrical terminal comprises a crimping portion and a contact portion adapted to mate with a corresponding male terminal to be inserted in the female terminal.

The contact portion comprises an outer frame having a top wall, a bottom wall parallel and opposed to the top wall, and two side walls perpendicular to and joining the top and bottom walls.

It further comprises an inner frame encased in a rear portion of the outer frame. Further, a first elastic contact member extends from the inner frame, and bears on an inner portion of the bottom wall. Further, a second elastic contact member extends from the inner frame and bears on an inner portion of the top wall.

Further, the first and second elastic contact members have a convex shape oriented toward one another. As a result they exert a clamping force greater than a predetermined value on the male terminal inserted in the female terminal.

Then, the elastic members have to slide respectively the top and bottom walls. This increases the strength of the elastic members on the male terminal compared to a configuration where the elastic members would have opposed only an elastic strength.

Further, such a terminal is less expensive to manufacture since it is made out of a single metal sheet. Contrarily to the terminal described in WO2008/120048 in which the elastic member is made of a part separate from the outer frame.

In other embodiments, one might also use one or more of the features as defined in the dependent claims.

According to another aspect, the invention is directed to a method to manufacture an electrical terminal as described above.

BRIEF DESCRIPTION OF THE SEVERAL VIEWS OF THE DRAWING

Other features and advantages of the invention appear from the following detailed description of one of its embodiments, given by way of non-limiting example, and with reference to the accompanying drawings.

In the drawings:

FIG. 3 is a partial sectional perspective view of the electrical connection between the terminal of FIG. 1 and a male counterpart, FIG. 4 is a partial perspective view showing the elastic members of the terminal of FIG. 1, FIGS. 5*a* to 5*f* show different steps of the folding method to result in the terminal of FIG. 1.

DETAILED DESCRIPTION OF THE INVENTION

On the figures, the same references denote identical or similar elements.

Figure 1:
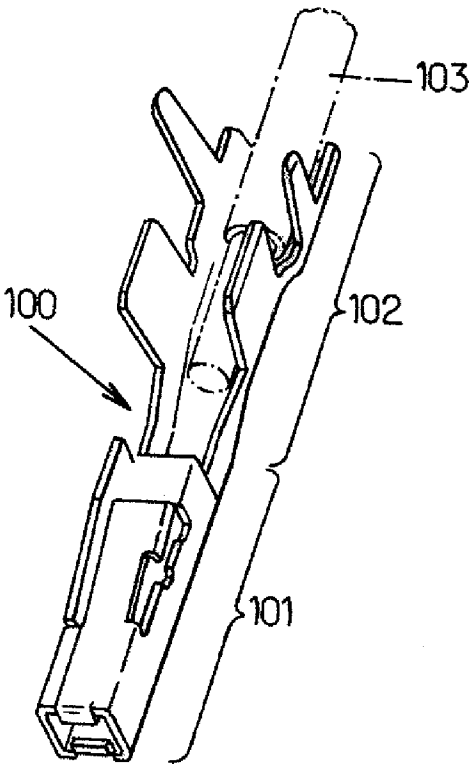
FIG. 1 is a general view of the terminal according to the invention.

FIG. 1 shows an electrical female terminal 100 according to an embodiment of the invention. The electrical female terminal 100 comprises: a crimping portion 102 known per se, adapted to be crimped on a wire 103, and a contact portion 101 adapted to mate with a corresponding male terminal 150 to be inserted therein along a longitudinal X axis in a front portion 17 of the contact portion 101 (see FIG. 2).

Figure 2:
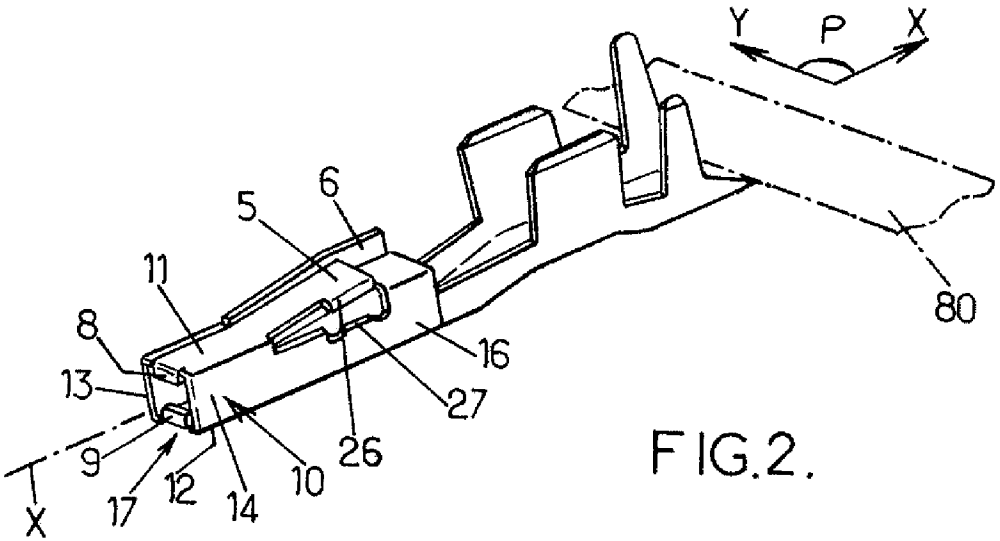
FIG. 2 is a side perspective view of the terminal of FIG. 1.

As shown on FIG. 2, the contact portion 101 comprises an outer frame 10 having a top wall 11, a bottom wall 12 parallel and opposed to the top wall 11, and two side walls 13, 14 perpendicular to and joining the top and bottom walls 11, 12. The top and bottom walls 11, 12 are parallel to a terminal insertion plane P containing the longitudinal X axis and a transversal Y axis perpendicular to the longitudinal X axis.

As it will be explained later, the outer frame 10 is obtained by folding a metal sheet, and it results from this process a joint or seam 30 joining edges 11*a* and 21*a* (visible on FIG. 3) respectively attached to the top wall 11 and a border 21 of the side wall 13. Both edges 11*a*, 21*a* of the seam 30 may be welded together to reinforce the strength of the outer frame 10. For example the outer frame 10 may comprise a laser soldered seam 30.

Further, the contact portion 101 comprises an inner frame 15 encased in a rear portion 16 of the outer frame 10, the rear portion 16 being longitudinally opposed to the already mentioned front portion 17, the crimping portion 102 being attached to this rear portion 16 (the crimping portion 102 is not shown on FIGS. 3 and 4).

As shown on FIG. 4, the inner frame 15 comprises: a U-shaped cross section with an intermediate portion 15*a* contiguous with the outer frame side wall 14, a first end portion 15*b* contiguous with the outer frame bottom wall 12, and a second end portion 15*c* contiguous with the outer frame top wall 11.

From the inner frame 15 are provided: a first elastic contact member 1 extending from the inner frame 15, in particular attached to the first end portion 15*b*, the first elastic contact member 1 bearing on an inner portion 12*b* of the bottom wall 12, a second elastic contact member 2 extending from the inner frame 15, in particular attached to the second end portion 15*c*, the second elastic contact member 2 bearing on an inner portion 11*b* of the top wall 11.

The first elastic contact member 1 comprises: a base portion 1*a* rigid, contiguous with the first end portion 15*b*, a curved portion 1*b* having a convex shape oriented toward the second elastic contact member 2 and having a contact area 1*e* at the apex of the convex shape, a sliding portion 1*c*, slidingly bearing on the inner portion 12*b* of the bottom wall 12, and having a tip 1*d* at the end thereof.

Similarly, the second elastic contact member 2 comprises: a base portion 2*a* rigid, contiguous with the second end portion 15*c*, a curved portion 2*b* having a convex shape oriented toward the first elastic contact member 1 and having a contact area 2*e* at the apex of the convex shape, a sliding portion 2*c*, slidingly bearing on the inner portion 11*b* of the top wall 11, and having a tip 2*d* at the end thereof.

Advantageously, the first elastic contact member 1 and second elastic contact member 2 are symmetrically disposed relative to the already mentioned terminal insertion plane P.

Further, the top wall 11 is prolonged by a protecting rim 8 extending inwardly substantially perpendicularly to both the top wall 11 and the X axis and parallel to the transversal Y axis.

Similarly, the bottom wall 12 is prolonged by a protecting rim 9 extending inwardly substantially perpendicularly to both the bottom wall 12 and the X axis and parallel to the transversal Y axis.

The protecting rims 8, 9 protect the contact portion 101 of the electrical female terminal 100 against mechanical damage upon insertion. It particularly prevents that the tips 1*d*, 2*d* respectively of the first and second elastic contact members 1, 2 be damaged by the misalignment of the tip 150*d* of the male terminal 150 (see FIG. 3).

Further, the contact portion 101 comprises a locking lance 5 adapted to lock the terminal 100 in a plastic housing as known in the art. The locking lance 5 extends slantwise outwardly from the front area of the top wall 11 and exhibits a sufficient flexibility to be pushed inwardly when the terminal 100 is inserted in a housing.

The contact portion 101 also comprises a protective wall 6 adapted to protect the locking lance 5 against mechanical damage, for example during the insertion of the terminal 100 in the plastic housing or during handling of the terminal 100 prior to insertion. This protective wall 6 is also advantageously used as orientation means. Indeed, the housing may be designed with a groove for accommodating the protective wall 6 only when the terminal 100 is properly oriented on the X axis, with regard to the housing. The protective wall 6 extends outwardly away from the outer frame 10 and comprises a slanted edge 6*a* prolonged by a second edge 6*b* parallel to the X axis.

Further, the locking lance 5 comprises a curved side portion 26 adapted to come into contact with a stop portion 27 belonging to the side wall 14 (cf. FIG. 2). This arrangement prevents the locking lance 5 from undergoing an excessive distortion when pushed inwardly by an unlocking tool.

When no male terminal 150 is inserted in the electrical female terminal 100, the first and second elastic members 1, 2 are in their rest position and their contact areas 1*e*, 2*e* are separated by a distance E2 (see FIG. 4).

Advantageously according to the invention, it is provided an electrical connection comprising a male terminal 150 having a thickness E1 and a female terminal 100 as described above. The thickness E1 of the male terminal 150 is greater that the distance E2 separating first and second elastic members 1, 2 in their rest positions.

As a result, when a male terminal 150 with a thickness E1 is inserted into the contact portion 101 of the female terminal 100, it pushes away outwardly the first and second elastic members 1, 2. The sliding portions 1*c*, 2*c* of the first and second elastic members 1, 2 bear and slide respectively on the inner surface 11*b*, 12*b* of respectively the top and bottom walls 11, 12. In fact, the fact that the elastic members have to slide respectively the top and bottom walls 11, 12 increases the strength of the elastic members on the male terminal 150 compared to a configuration where the elastic members would have opposed only an elastic strength.

As a result, the first and second elastic members 1, 2 exert a clamping force greater than 5 Newtons on the male terminal 150 inserted therein. Furthermore, this clamping force is symmetrically exerted on the male terminal 150 which is beneficial for the mechanical balance of the electrical connection.

Figure 6:
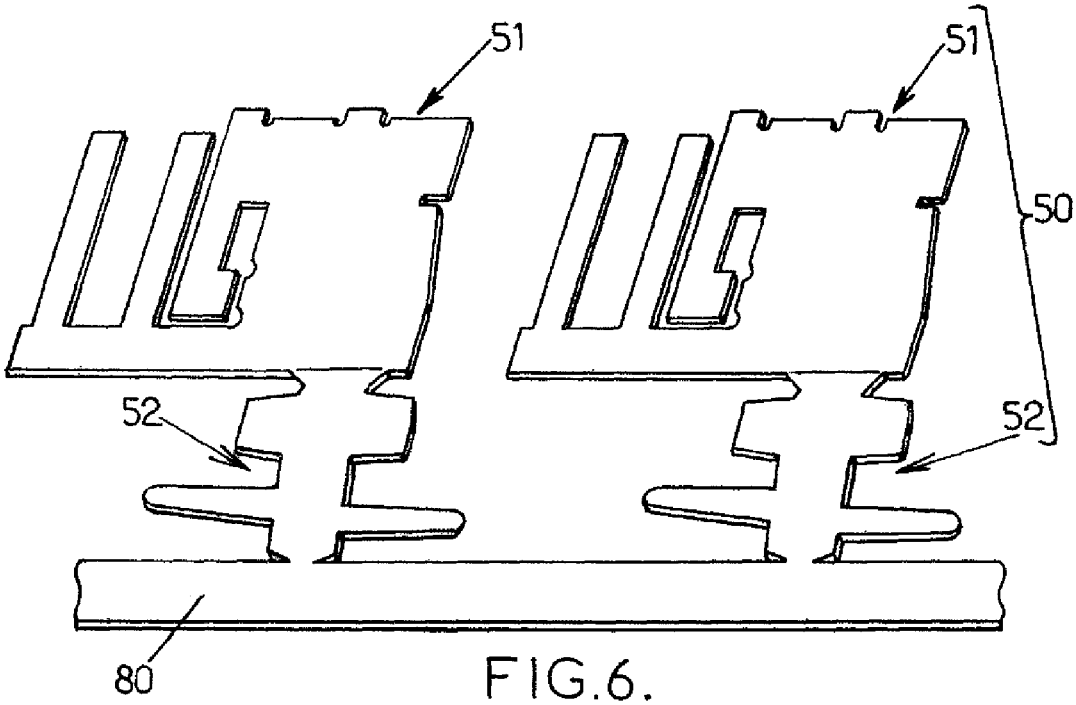
FIG. 6 shows a band comprising a strip and a plurality of metallic blanks adapted to be folded into a plurality of terminals like the one of FIG. 1.
Figure 7:
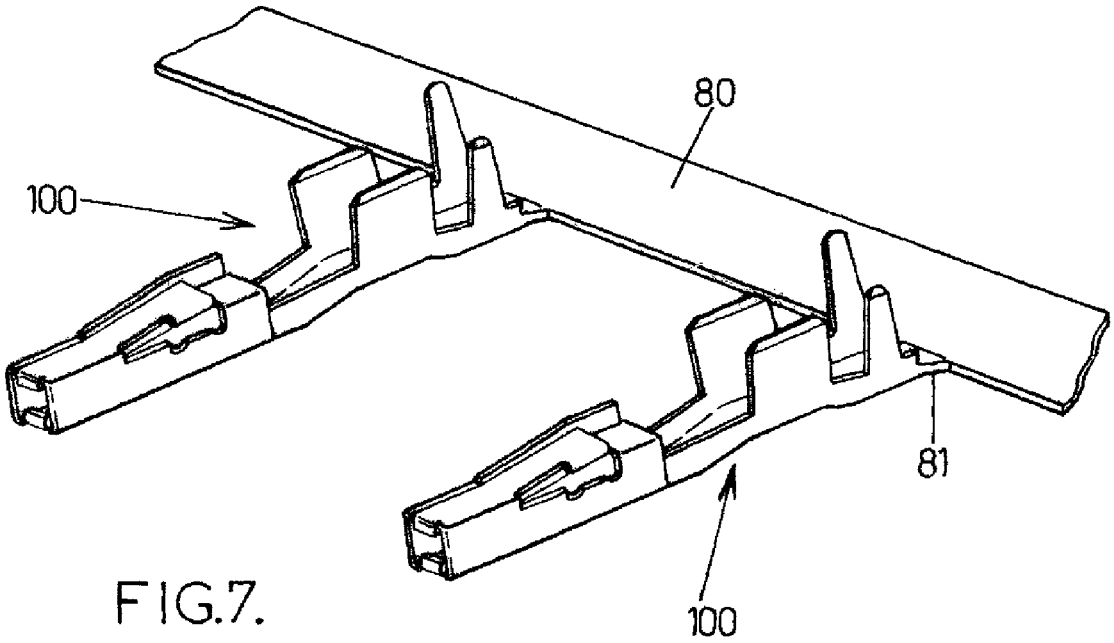
FIG. 7 shows a band comprising a strip and a plurality of terminals like the one of FIG. 1.

Before crimping a wire 103 on the female terminal 100, the female terminal 100 is attached to a strip 80 as shown on FIGS. 2, 6 and 7.

The manufacturing process will be now explained in details.

First of all, it is provided a band as shown on FIG. 6. The band comprises a continuous strip 80 and a plurality of metallic blanks 50 each one of which being attached to the strip 80 and adapted to be folded in order to form a female terminal 100 as described above. Such a band is obtained from stamping a metallic sheet. Each blank 50 comprises a first blank portion 51 corresponding to the contact portion 101 and a second blank portion 52 corresponding to the crimping portion 102.

The folding of the second blank portion 52 corresponding to the crimping portion 102 is known in the art and therefore will not be described in details here.

The folding of the first blank portion 51 corresponding to the contact portion 101 is described here below with reference to the FIGS. 5*a* to 5*f*.

The first blank portion 51 corresponding to the contact portion 101 is a stamped flat metal sheet extending in a plane comprising the longitudinal X axis and the transversal Y axis. The first blank portion 51 comprises: a first strip 1' extending along the longitudinal X axis, having a first base portion 1'*a* and a tip 1'*d*, a second strip 2' extending along the longitudinal X axis, having a second base portion 2'*a* and a tip 2'*d*, a third strip 15' extending along the transverse Y axis and joining the first base portion 1'*a* and second base portion 2'*a*, the third strip 15' corresponding to the inner frame 15, a generally rectangular shaped main portion 10' comprising shapes (10', 16',5',6',8',9', 11', 26', 27') adapted to be folded to give respectively the outer frame 10, the rear portion 16 of the outer frame 10, the locking lance 5, the protective wall 6, the protecting rims 8,9, the curved side portion 26, the stop portion 27.

Figure 5A:
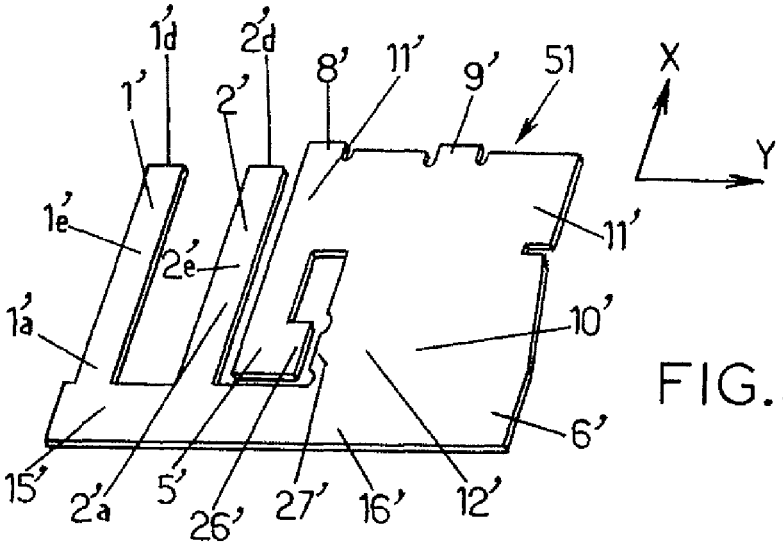
Figure 5B:
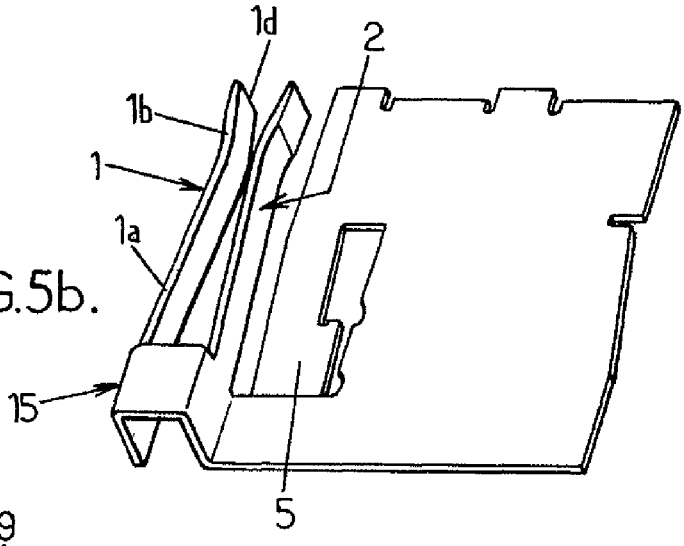

As shown on FIG. 5*b*, the third strip 15' is folded as a U-shape in such a way that the first strip 1' and second strip 2' faces each other and form the elastic contact members 1, 2 and the inner frame 15 of the electrical terminal 100. Further the locking lance 5 is also formed at this step of the process.

Figure 5C:
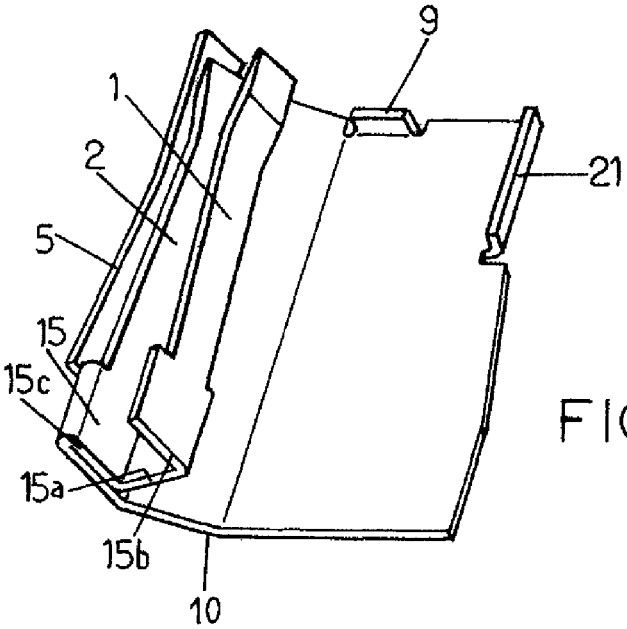

As shown on FIG. 5*c*, further processing comprises the forming of the border 21, the protecting rims 8, 9 and partly forming the outer frame 10.

Figure 5D:
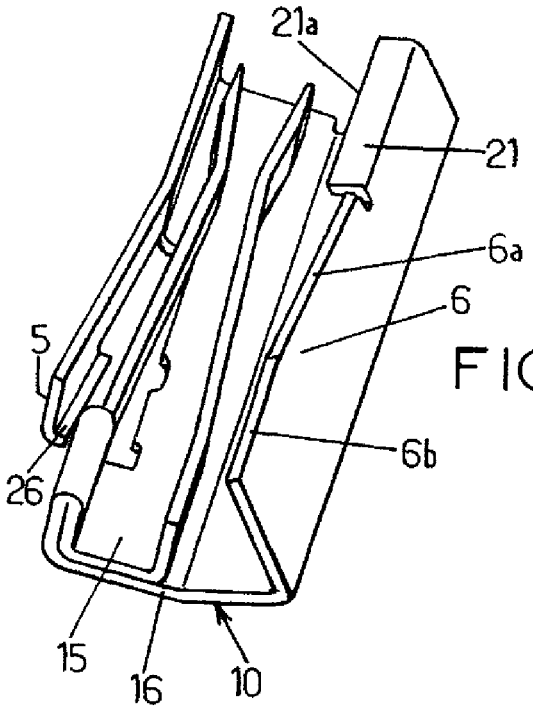
Figure 5E:
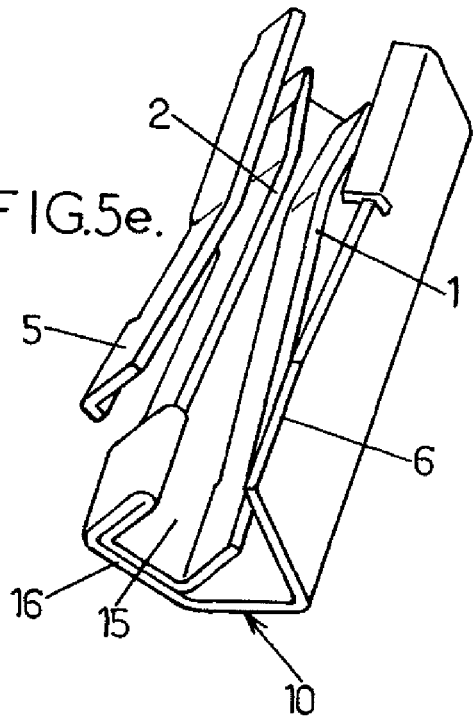

As shown in FIGS. 5*d* and 5*e*, the outer frame 10 is further folded.

Figure 5F:
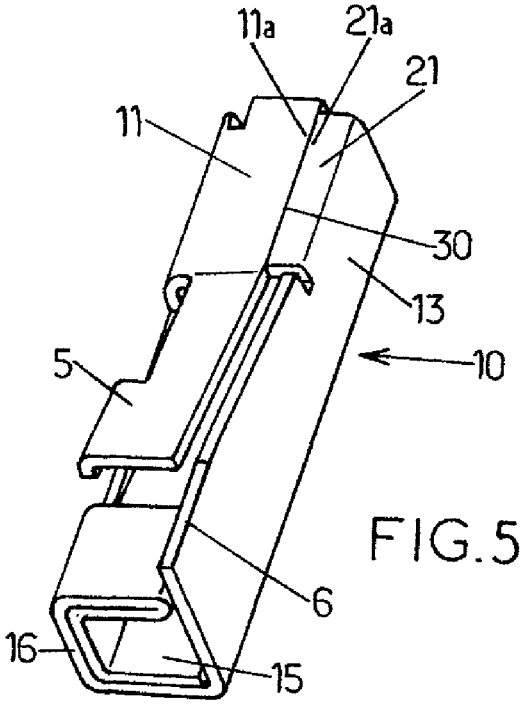

Finally, as shown on FIG. 5*f*, the outer frame 10 is closed and the edge 21*a* of the border 21 forms together with the edge 11*a* the already mentioned joint or seam 30.

A further process may include the welding of such seam 30, for example by laser welding technique.

The folding of the second blank portion 52 to result in the crimping portion 102 may be performed simultaneously.

As a result of the forming process, it is provided a band comprising a continuous strip 80 and a plurality of terminals 100 attached to the strip 80, as illustrated on FIG. 7. A breakable section 81 attaches each terminal 100 to the strip 80 and can be broken or cut out to give individual electrical terminals 100.

The process may also include a surface treatment step, like for example a gold plating treatment that can be performed on the whole band with blanks or that can be performed locally on the elastic contact members 1, 2, especially on the contact areas 1*e*, 2*e*.

The invention claimed is:

1. An electrical female terminal, manufactured from a single metal sheet, comprising a crimping portion and a contact portion adapted to mate with a corresponding male terminal to be inserted therein in a front portion of the contact portion, the contact portion comprising:

an outer frame having a top wall, a bottom wall parallel and opposed to the top wall, and two side walls perpendicular to and joining the top and bottom walls;

an inner frame encased in a rear portion of the outer frame;

a first elastic contact member extending from the inner frame, and bearing on an inner portion of the bottom wall;

a second elastic contact member extending from the inner frame and bearing on an inner portion of the top wall, and a locking lance adapted to lock the terminal in a housing and a protective wall adapted to protect the locking lance against mechanical damage, wherein the first and second elastic contact members have a convex shape oriented toward one another.

2. The terminal according to claim 1, wherein the first elastic contact member and the second elastic contact member are symmetrically arranged relative to a terminal insertion plane parallel to the top wall.

3. The terminal according to claim 1, wherein each of the first and second elastic contact members have respectively a base portion rigid with the inner frame, a curved portion and a sliding portion slidingly bearing on the inner portion respectively of the top and bottom walls.

4. The terminal according to claim 1, wherein the inner frame has a U-shaped cross section with an intermediate portion and end portions, wherein the first and second elastic contact members are respectively attached to each one of the end portions.

5. The terminal according to claim 1, wherein each of the top wall and the bottom wall is respectively prolonged by an protecting rim extending inwardly substantially perpendicularly to the top wall whereby the first and second elastic contact members are protected from mechanical damage upon insertion of the corresponding male terminal.

6. The terminal according claim 1, wherein the first and second elastic contact members are locally gold plated.

7. The terminal according to claim 1, wherein the outer frame comprises a laser soldered seam.

8. An electrical connection comprising a male terminal and a female terminal according to claim 1, wherein the first and second elastic members exert a clamping force greater than 5 Newtons on the male terminal inserted therein.

9. A band comprising a continuous strip and a plurality of terminals according to claim 1 attached to the strip.

10. A method for manufacturing an electrical female terminal having a crimping portion and a contact portion adapted to mate with a corresponding male terminal to be inserted therein in a front portion of the contact portion, wherein an outer frame of the contact portion has a top wall, a bottom wall parallel and opposed to the top wall, and two side walls perpendicular to and joining the top and bottom walls, wherein an inner frame of the contact portion is encased in a rear portion of the outer frame, wherein a first elastic contact member of the contact portion extends from the inner frame and bears on an inner portion of the bottom wall and a second elastic contact member of the contact portion extends from the inner frame and bears on an inner portion of the top wall, and wherein the first and second elastic contact members have a convex shape oriented toward one another, the method comprising the steps of:

providing a flat metal sheet extending in a plane comprising a longitudinal axis and a transversal axis, the flat metal sheet comprising a first blank portion to be folded to provide the contact portion and a second blank portion to be folded to provide the crimping portion, the first blank portion comprising:

a first strip extending along the longitudinal axis, having a first base portion, a second strip extending along the longitudinal axis, having a second base portion, a third strip extending along the transversal axis and joining the first base portion and second base portion, a generally rectangular shaped main portion;

laterally folding the first, second and third strips to form the first and second elastic contact members and the inner frame of the electrical female terminal;

laterally folding the inner frame onto the generally rectangular shaped main portion;

laterally folding the generally rectangular shaped main portion around the inner frame to form the outer frame; and folding the second blank portion to form the crimping portion.

11. The method according to claim 10, comprising the additional step of welding a seam on the outer frame to result in a closed outer frame.

12. The method according to claim 10, wherein the method does not include a step of joining a seam on the inner frame to result in a closed inner frame.

13. The method according to claim 10, wherein the method further comprises the steps of:

forming a locking lance joined to the outer frame adapted to lock the terminal in a housing; and forming a protective wall of the outer frame adapted to protect the locking lance against mechanical damage.

* * * * *